United States Patent [19]

Scalzo

[11] Patent Number: 4,727,761

[45] Date of Patent: Mar. 1, 1988

[54] WOBBLE PLATE ENGINE STABILIZER MECHANISM

[75] Inventor: Joseph Scalzo, Kew, Australia

[73] Assignee: Scalzo Patents Pty. Ltd., Victoria, Australia

[21] Appl. No.: 30,443

[22] Filed: Mar. 25, 1987

[30] Foreign Application Priority Data

Mar. 27, 1986 [AU] Australia ..... PH5226

[51] Int. Cl.[4] ..... F16H 23/00; F04B 1/26

[52] U.S. Cl. ..... 74/60; 417/269

[58] Field of Search ..... 74/60, 839; 123/58 B, 123/58 BA, 58 BB, 58 BC; 417/269

[56] References Cited

U.S. PATENT DOCUMENTS

| | | | |
|---|---|---|---|
| 1,355,485 | 10/1920 | Lleo et al. | 74/60 |
| 1,788,609 | 1/1931 | Andrews | 74/60 |
| 2,551,025 | 5/1951 | Lindeman | 74/60 |
| 2,982,218 | 5/1961 | Lucien | 74/60 |
| 3,841,586 | 10/1974 | Broadley et al. | 74/60 |
| 4,152,944 | 5/1979 | Kemper | 74/60 |
| 4,688,439 | 8/1987 | Cureton et al. | 74/60 |

FOREIGN PATENT DOCUMENTS

| | | | |
|---|---|---|---|
| 1930796 | 8/1970 | Fed. Rep. of Germany | 74/60 |
| 638865 | 2/1928 | France | 123/58 CC |
| 1364086 | 5/1964 | France | 74/60 |
| 53-00410 | 1/1978 | Japan | 417/269 |
| 842360 | 7/1960 | United Kingdom | 417/269 |

*Primary Examiner*—Lawrence Staab

*Attorney, Agent, or Firm*—Merchant, Gould, Smith, Edell, Welter & Schmidt

[57] ABSTRACT

A wobble plate engine mechanism includes a stabilizer mechanism operating between a wobble plate and a mounting on the engine cylinder block or associated engine case. The stabilizer mechanism has first and second mutually inclined, elongate link means, the first link means having one end connected to the wobble plate by a first pivotal coupling and the second link means having one end connected to the mounting by a second pivotal coupling, spaced axially with respect to the mainshaft from the first coupling, with the link means being connected together at their other ends by a third pivotal coupling. The third coupling is centered on a bisecting plane for the wobble plate, the plane bisecting the angle between the wobble plate and a plane perpendicular to the longitudinal axis of the mainshaft. The third pivotal coupling has three degrees of freedom, and the second pivotal coupling contrains the second link means so as to be pivotable only on a pivot axis which is spaced from and substantially at right angles to the mainshaft. The engine mechanism may include a drawing system for altering the displacement of the mechanism, the drawing system including an annular cylinder fixed to the cylinder block or to an associated engine case, the cylinder being concentric with respect to the mainshaft and having therein a non-rotatably annular piston axially fixed relative to the mainshaft, the system being operable such that movement of the piston under pressure moves the mainshaft along its axis.

12 Claims, 3 Drawing Figures

WOBBLE PLATE ENGINE STABILIZER MECHANISM

This invention relates to wobble plate mechanisms of fixed and variable displacement types, and is applicable to internal and external combustion engines and pumps.

Wobble plate engine mechanisms broadly comprise a plurality of piston/cylinders arranged parallel around the axis of an output-shaft, and each coupled to a respective arm of a wobble plate which is rotatably mounted on a wobble carrier obliquely mounted on the output-shaft. As the output-shaft rotates, each piston is forced to reciprocate in its cylinder, and vice versa.

In Austrailian application No. 41322/85 (corresponding to U.S. Ser. No. 723,731, Japanese No. 82110/85 and EPO No. 85302705.0) there is described a variable displacement wobble plate engine mechanism in which displacement is infinitely variable between predetermined upper and lower limits, while maintaining substantially constant compression ratio. In that application a system for stabilising or damping the oscillating motion of the wobble plate is described.

The present invention is directed to providing an alternative wobble plate engine of the above mentioned type having an improved arrangement for a mechanical system of stabilisation. In a preferred form, the invention provides an improved hydraulic shaft-drawing system for altering the displacement of the engine for use in a wobble plate engine mechanism having the improved form of stabilization.

The improved wobble plate engine mechanism of the invention includes a cylinder block having a mainshaft rotatably therein; a drive hub obliquely mounted on the mainshaft for rotation therewith; a wobble plate rotatably mounted on the drive hub; and a plurality of cylinders arranged around the mainshaft, each with a piston reciprocally movable therein along a respective axis substantially parallel to the rotational axis of the mainshaft, each piston being coupled to a respective arm of the wobble plate. The coupling between each piston and respective arm preferably is via a gudgeon-pin and a cross-head reciprocable in a bore of an extension of the piston, as described in Australian patent specification No. 545777.

As will be appreciated, as the mainshaft and drive hub rotate, each arm of the wobble plate traverses a lemniscate path (a figure of eight on the surface of a sphere). This movement is accommodated in the coupling by the radial freedom afforded by the cross-head in the piston extension bore and the tangential freedom afforded by the end-wise movement of the gudgeon-pin, with its arm, in the cross-head bore. The amplitude of the end-wise movement of the gudgeon-pin is a function of the piston displacement. For an engine to be kinematically stable at all variable displacement positions, the respective lemniscate path corresponding to each angular position of the wobble plate, must be allowed to occur.

In the present invention, stabilization is achieved by a stabiliser mechanism operating between the wobble plate and the engine case, comprising a pair of links of substantially equal length, a first end of a first link being pivotally coupled to the wobble plate, such as to the periphery of one side thereof, and a first end of the second link being pivotally coupled to the engine case. The second end of each link forms part of a pivotable coupling between the links which is centered on a bisecting plane for the wobble plate, which plane bisects the angle between the wobble plate and a plane perpendicular to the longitudial axis of the mainshaft.

The links may extend substantially radially with respect to the engine mainshaft. Alternatively, they may extend substantially tangentially with respct to the wobble plate. In a further alternative they may extend in a direction which is intermediate such radial and tangential forms. However, in each case, the first ends of the links most preferably are mutually spaced in the longitudinal direction of the mainshaft.

The one end of the second link may be pivotally coupled directly to the engine case, and this is preferred where the engine is of fixed displacement. However, in the case of a variable displacement engine, it is highly desirable that the one end of the second link is indirectly coupled to the engine case, such as on a member movable in the longitudinal direction of the engine case. In the latter case, the movable member preferably is movable in unison with the mainshaft to retain integrity of the mechanism.

The stabiliser mechanism most preferably provides a constant velocity coupling between the engine case and the non-rotating wobble plate.

Of the three pivotable couplings, that is the respective coupling at the one end of each link and the coupling between the second end of each link, at least one has three degrees of freedom. In some instances, it is desirable that two of the couplings has three degrees of freedom, although it is not appropriate for all three couplings to be of such form.

Where the links extend approximately radially of the engine, that is, at an angle of not more than about 10° to 15° to the radial, it is preferred that only one of the couplings has three degrees of freedom, with the coupling being between the second ends of the links. The other two couplings are to provide only a pivot axis which is spaced from, but substantially at right angles to the mainshaft. However, while the pivot axes of the other two couplings are in respective, substantially parallel planes, they may themselves be parallel or oppositely inclined in such planes.

Where the links extend substantially tangentially of the wobble plate, or at an angle of more than about 15° to the radial, it is preferred that two of the couplings may have three degrees of freedom, with a first one of those couplings being at the one end of the first link and the second one of those couplings being between the second end of the links. The third coupling in such case, that is, the coupling at the first end of the second link provides only a pivot axis which is substantially perpendicular to, and most preferably intersects the longitudinal axis of the mainshaft. Where the coupling at the one end of the first link does not provide three degrees of freedom, it may be a pivot pin extending radially, outwardly from the wobble plate.

The or each such coupling with three degrees of freedom may comprise a ball joint, comprising a ball rotatably located in a cup-shaped or annular member. However, other forms joint providing three degrees of freedom can be used.

In the preferred form of the invention, applicable where the engine mechanism is of a variable displacement type, the shaft-drawing system comprises an annular cylinder fixed to the engine case, concentrically with the mainshaft, and an annular piston within the cylinder and axially fixed relative to the mainshaft; the arrangement being such that movement of the piston under pressure draws the mainshaft along its axis. The piston/- cylinder arrangement can be of single or double acting configuration, depending on the desired engine balancing, controlling the axial load on the mainshaft. That arrangement preferably is hydraulically operable. Also, the piston, while axially fixed on the mainshaft, may be co-axially rotatable relative to the mainshaft.

The piston may be axially fixed to a link pin member such that, during operation of the piston/cylinder arrangement, the link pin member moves with the mainshaft. The link pin member preferably is spaced from, but extends substantially parallel to, the mainshaft. In one form, it extends through, and is slidable in, an aperture defined by the engine case.

In the preferred form of the invention, the coupling between the first end of the second link and the engine case may be indirect; that coupling being between the second link and the link pin member. As a consequence, the stabilising arrangement is moveable along the axis of the mainshaft as the mainshaft is moved along its axis by the shaft-drawing system.

In a preferred form of the shifting means, the drawing member is an annular hydraulic cylinder fixed to the engine case. An annular piston is axially fixed relative to the main shaft but co-axially rotatable relative thereto such that on application of oil, under pressure, between the piston and cylinder members the piston draws the mainshaft along its axis. The piston/cylinder arrangement can be of single or double acting configuration depending on the desired engine balancing, controlling the axial load on the mainshaft.

Most conveniently, the piston member is axially fixed to the slidable link pin member thus simultaneously altering the pivot of the stabiliser link in order to maintain correct geometry of the stabiliser system.

The invention will now be described by way of example and with reference to the accompanying drawings in which.

The engine to which the invention is applied is of the wobble plate type incorporating a floating wobble plate whether it be of fixed stroke, or whether it be one in which variable angularity and position of the wobble plate gives rise to variable stroke with or without constant compression ratio.

Figure 1:
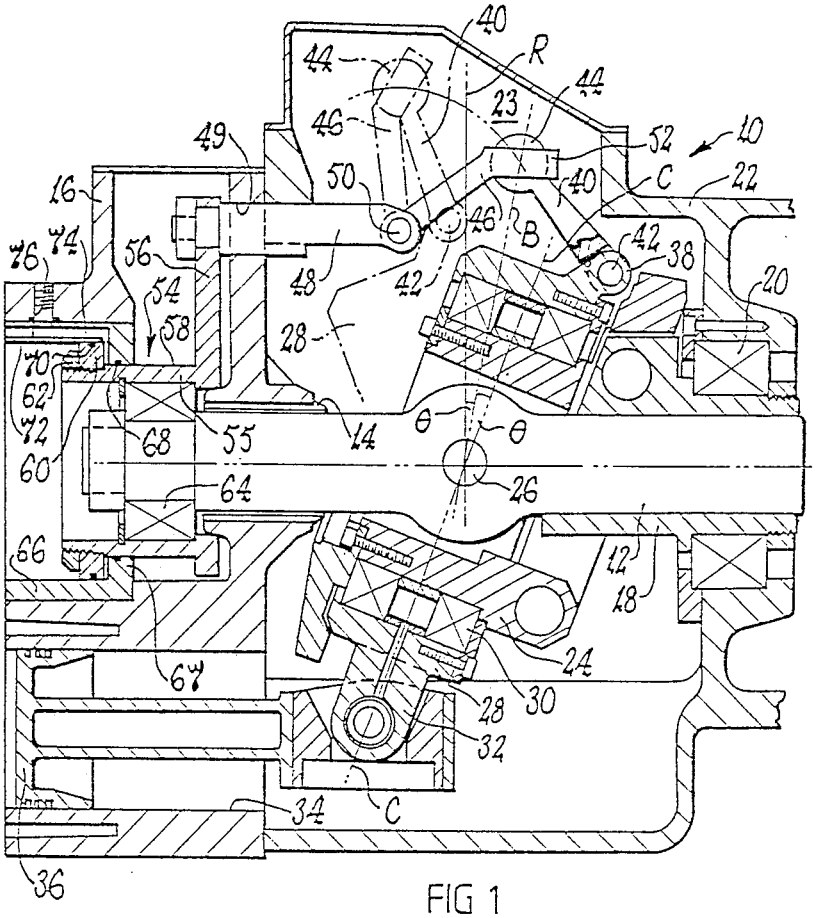
FIG. 1 is a longitudinal cross-section of the engine mechanism illustrating aspects of the invention with one piston in the top dead centre position and the engine in the maximum displacement position.

FIG. 1 shows details of the engine 10 sufficient to illustrate clearly the application of the invention. In engine 10, a mainshaft 12 is mounted in bearing 14 on a cylinder block 16 and slidably coupled to an anchor sleeve 18. The anchor sleeve 18 is mounted in radial and thrust bearing 20 on the engine case 22. The mainshaft 12 supports a drive hub 24, pivotally mounted on trunnion pin 26. An annular wobble plate 28 is mounted in thrust and radial bearings 30 on the drive hub 24, and includes a plurality of circumferentially spaced arms 32 (one for each piston) extending radially therefrom. A plurality of cylinders 34 in cylinder block 16 are arranged around the mainshaft 12, with their axis parallel thereto, and a piston 36 is reciprocally movable in each cylinder 34.

The wobble plate 28 also has incorporated thereon a pivot arm 38, usually placed between two arms 32, but offset from the radial center-line C passing through the trunnion pin 26 and the center of each arm 32. The offset should be as large as possible within the constraints of practicality. One end of link 40 is rotatably connected to pivot arm 38 via a pin 42. While pin 42 is shown as generally tangential with respect to the radial plane of the wobble plate 28, this is not necessarily the case. The other end of link 40 contains a ball 44, either integral with or separable from link 40.

A further link 46 has one end thereof rotatable on pivot bar 48, via a pin 50. Pivot bar 48 is slidable but not rotatably in aperture 49 in cylinder block 16 and rear case 22. The other end of link 46 forms a split female ball joint 52 with ball 44 of link 40.

The geometry of the link stabiliser accords with the following rules:

The distance between the center of ball 44 and the center of pins 42 and 50 is equal.

The axis of pins 42 and 50 may be parallel, or of opposite equal inclination to a radial tangent of the wobble plate 28.

The center of the coupling comprising of ball 44 and female ball joint 52, is on the bisecting plane B which is defined as a plane half way between the radial center line C of the wobble plate 28 and radial plane R perpendicular to the longitudinal axis of the mainshaft 12, and defined as angle $\theta$, plane B being to either side of plane R.

By drawing a line perpendicular to the bisecting plane B and passing through the center of pin 42, the position of pin 50 is defined.

For an engine of variable stroke, those rules necessitate the ability to alter the position of pin 50 in unison with the mainshaft as the latter is drawn axially to alter the stroke of the engine by alteration of the angle and position of wobble plate 38. For altering mainshaft 12 and plate 38, there is provided a non-rotating, annular piston and drawing bar assembly 54. As shown, assembly 54 comprises a cylindrical hub 55 mounted co-axially on mainshaft 12 via radial and thrust bearing 64; with hub 55 defining a cylindrical external surface 58 and carrying a radially extending drawing bar 56. Assembly 54 further includes an annular piston member 60 engaged on a threaded portion of surface 58 and retained thereof by nut 62. Fixed to cylinder block 16, there is a cylinder 66 in which piston member 60 is axially slidable, with seal 70 around member 60 providing a seal against bore 72 of cylinder 66. A further seal 68 around the inner circumference of flange 67 of cylinder 66 provides a seal around surface 58 of hub 55. An oil passage 74 in cylinder 66 communicates with a port 76 connectable to a source of pressurized oil, allowing oil to flow under pressure from passage 74, between piston member 60 and flange 67 of cylinder 66. With such flow, piston member 60 is caused to be moved to the left, in the arrangement as shown in FIG. 1, drawing hub 55 and, with it, bar 56, mainshaft 12, hub 24 and wobble plate 28. Also, the end of bar 48 remote from pin 50 is bolted to bar 56, such that bar 48 and pin 50 are drawn in unison with mainshaft 12 under the action of assembly 54.

In the arrangement illustrated, assembly 54 in effect is a piston/cylinder of a single acting configuration. However, it may if required be of a double acting configuration, enabling positive oil pressure movement of mainshaft 12 in either axial direction. Where the single acting configuration is provided, as illustrated, reverse movement of mainshaft 12 (i.e. to the right in the view of FIG. 1) can be provided by biasing means. The biasing means could, for example, be a coil spring around hub 55 and acting between bar 56 and flange 67, with oil pressure between piston member 60 and flange 67 being regulated to position mainshaft for a required engine stroke.

Figure 2:
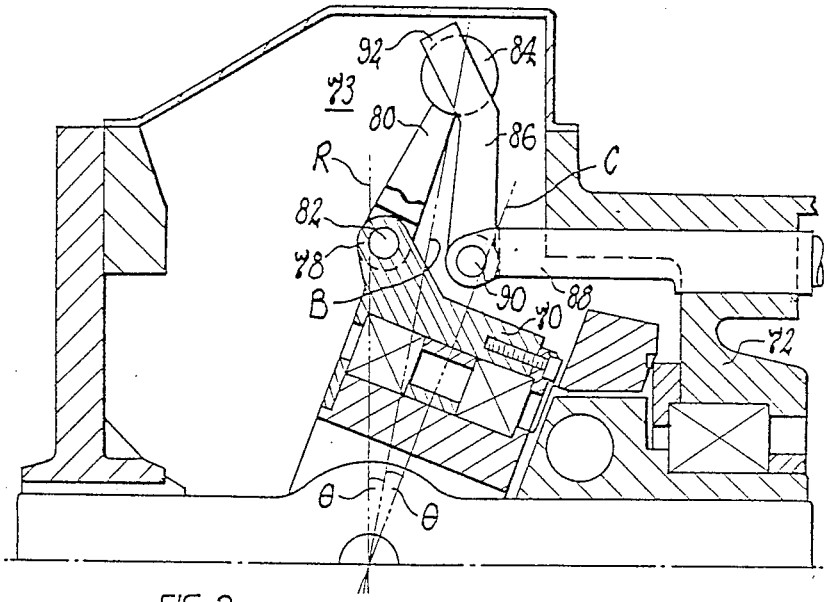
FIG. 2 is a partial section of the link stabilising mechanism with a reverse embodiment to that of FIG. 1, for engines having the adjusting mechanism from the rear of the engine.

In FIG. 2, the wobble plate 70 has a pivot arm 78 offset from the radial center line C of the wobble plate 70 on the opposite side to the pivot arm 28 of FIG. 1. One end of a first link 80 is rotatably connected to pivot arm 78 via pin 82. The other end of link 80 contains a ball 84, either integral with or separable from link 80.

A further link 86 has one end rotatable on pivot bar 88 via pin 90. Pivot bar 88 is slidable but not rotatable in rear case 72. The other end of link 86 forms a split female ball joint 92 with ball 84 of link 80. The geometry of the link stabiliser of FIG. 2, follows the same rules as described above in relation to FIG. 1.

Pivot bar 88 can be connected to a similar hydraulic cylinder system as that described in FIG. 1, but operating from the opposite end of mainshaft 12.

The plane of the link stabiliser comprising links 40,46 described in FIG. 1, as well as that comprising links 80,86 in FIG. 2, is a radial plane of the respective mainshaft 12,74. However, with suitable connection, the plane of the link stabiliser can be at any angle from such radial plane through to a plane parallel to a tangent to the mainshaft 12,74, provided that there is sufficient space between the engine cylinders, or provided that the pivot arm 38,78 on the wobble plate 24,70 is extended so that the stabiliser is clear of the cylinders.

Figure 3:
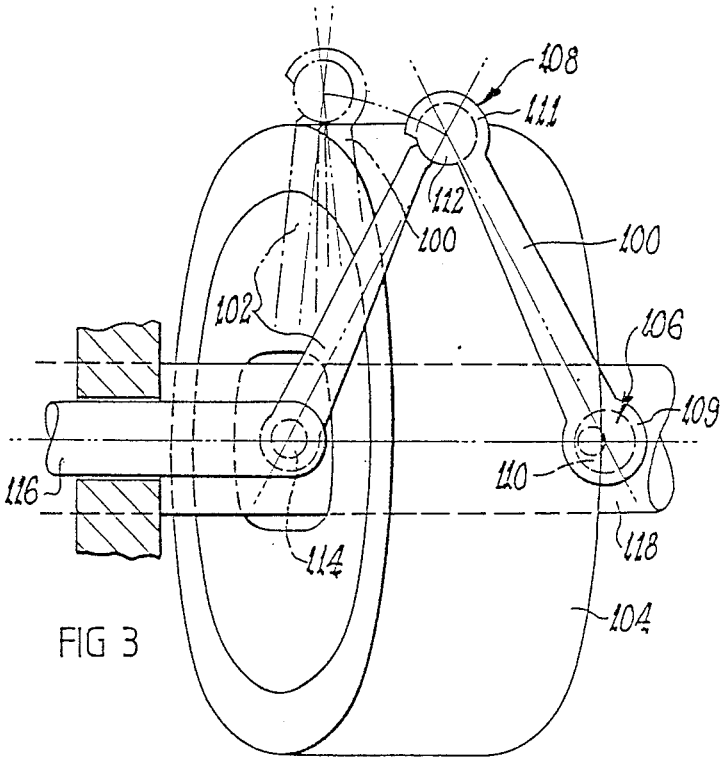
FIG. 3 is a view showing another embodiment of the link stabiliser at right angles to that of FIGS. 1 and 2, demonstrating that the links can be placed at any practical angle around the periphery of the wobble plate.

FIG. 3 is a schematic representation of a tangential stabiliser. In FIG. 3, the view is taken from above the engine relative to the view in each of FIGS. 1 and 2. However, in this instance, links 100 and 102 extend tangentially rather than radially. Also, link 100 is coupled to wobble plate 104 by a ball joint 106, while a second ball joint 108 is provided between links 100,102. In each case, the ball joint is defined by a respective spherical cup 109,111 at each end of link 100 and a respective ball 110,112 on wobble plate 104 and link 102. Again, the other coupling is provided by a pin 114, which couples link 102 to pivot slide bar 116; with pin 114 having its pivot axis extending radially in this instance with respect to mainshaft 118. Bar 116 corresponds to bar 48 of FIG. 1, and is slidable under the action of a piston/cylinder drawing system such as described in relation to FIG. 1.

As with the embodiment of FIGS. 1 and 2, the stabiliser is operable in accordance with the rules described above in relation to FIG. 1.

In each of FIGS. 1 to 3, the wobble plate is shown in one extreme position for operation of the engine. In FIG. 1, the broken outline shows part of wobble plate 28 as in its other extreme position; while the broken outline of links 40,46 illustrate the relative disposition of the links with the wobble plate in its other extreme position. The partial, broken outline of links 100,102 in FIG. 3 similarly illustrate their disposition with wobble plate 104 in its other extreme position.

In operation of the engines, a point on the periphery of the wobble plate traverses a lemniscate path. The coupling between each wobble plate 24,70,104 and the respective first link 40,80,100 follows such path and freedom permitted by the respective ball joints allows for this. However, in each case, the links provide stabilisation for the oscillating motion of the wobble plate.

The foregoing description will suffice for those skilled in the art of wobble plate mechanisms. However, further brief comment is provided for those less familiar with those mechanisms and initially is directed to the arrangement of FIG. 1.

During operation of the engine at a given stroke length, wobble plate 28 is caused to oscillate in its familiar mode. In that movement, any point on its periphery traces a lemniscate path, which is a figure of eight on the surface of a sphere. Arm 38 and the coupling thereto with link 40, provided by pin 42, follows the same path. In the arrangement illustrated, each of links 40 and 46 are constrained by the respective pins 42,50 so as to pivot parallel to the plane of the section of FIG. 1. During operation of the engine, link 46 continues to be able to pivot only parallel to that section, with ball joint 52 and ball 44 thereof moving parallel to that section with pivoting of link 46 on pin 50. However, as arm 38 traverses a lemniscate path, the lower end of link 40 also moves in such path, first to one side of the section and then to the other. That movement of the lower end of link 40 is accompanied by changes in the inclination of pin 42 with respect to the section of FIG. 1 as it moves laterally towards and away from pin 50, and also by swivelling of ball 44 of joint 52.

As an assembly, the center of joint 52 reversably follows the arcuate path shown in FIG. 1. To provide further stabilization, the inner surfaces 23 of rear case 22, to each side of that path, may define a guideway in which joint slides; such guideway resulting in torque applied to links 40,46 being at ball joint 44 rather than at pin 50.

As will be appreciated, movement of pin 50 with bar 48, under the action of assembly 54, does not change the stabilizing action of links 40,46. Rather, it simply adjusts links 40,46 in unison with axial movement of mainshaft 12 and corresponding change in the position and angle of wobble plate 28.

The arrangement of FIG. 2 is completely analogous to that of FIG. 1. Also, the inner surfaces 73 of engine case 72, to each side of the path of arcuate movement of joint 92, can define a guideway for joint 92, again locating any torque at ball joint 92 rather than at pin 90.

While links 100,102 in the arrangement of FIG. 3 are horizontally disposed, rather than vertically disposed as with links 40,46 of FIG. 1 and links 80,86 of FIG. 2, the arrangement again is analogous with that of FIG. 1. However, in this arrangement, it is necessary that a joint having three degrees of freedom be provided at each end of link 100, i.e. the one of the links connected to the wobble plate.

Considering an engine in the disposition shown in FIGS. 1 and 2, it is not necessary that the links be vertically disposed, i.e. radial, as in those Figures. Thus, the links can be horizontally disposed, i.e. tangential, as in FIG. 3. Also, the links can be at any intermediate angle between the radial and tangential extremes. Where the links are at an intermediate angle, it is necessary that a respective joint having three degrees of freedom be provided at each end of the link connected to the wobble plate.

As indicated, the stabilising arrangement can be used in either fixed or variable displacement engines. Also, two or more such arrangements can be used, each being placed between respective pairs of successive wobble plate arms.

Finally, it is to be understood that various alterations, modifications and/or additions may be introduced into the constructions and arrangements of parts previously described without departing from the spirit or ambit of the invention.

I claim:

1. A wobble plate engine mechanism including a cylinder block having a mainshaft rotatable therein; a drive hub mounted obliquely on the mainshaft for rotation therewith; a wobble plate rotatably mounted on the drive hub; a plurality of cylinders arranged around the mainshaft, each with a piston reciprocally movable therein along a respective axis substantially parallel to the mainshaft, each piston being coupled to a respective arm of the wobble plate; and a stabilizer mechanism operating between the wobble plate and a mounting on the cylinder block or associated engine case, the stabilizer mechanism comprising first and second mutually inclined, elongate link means, the first link means having one end connected to the wobble plate by a first pivotal coupling and the second link means having one end connected to said mounting by a second pivotal coupling, spaced axially with respect to the mainshaft from said first couping, with said link means being connected together at their other ends by a third pivotal coupling centered on a bisecting plane for the wobble plate, said plane bisecting the angle between the wobble plate and a plane perpendicular to the longitudinal axis of the mainshaft; said third pivotal coupling having three degrees of freedom, and said second pivotal coupling constraining said second link means so as to be pivotable only on a pivot axis which is spaced from and substantially at right angles to the mainshaft.

2. A mechanism according to claim 1, wherein said link means extend not more than about 15° from radially with respect to the mainshaft, with said first coupling constraining said first link means to pivot relative to the wobble plate only on an axis spaced from the mainshaft and tangentially with respect to the wobble plate, said pivot axis being spaced from and extending laterally of the mainshaft.

3. A mechanism according to claim 1, wherein said link means extend substantially radially with respect to said mainshaft, with said first coupling being a joint having three degrees of freedom.

4. A mechanism according to claim 1, wherein said link means extend at more than about 15° from radially with respect to said mainshaft, said first coupling being a joint having three degrees of freedom.

5. A mechanism according to claim 4, wherein said link means extend substantially parallel to a plane tangential with respect to said mainshaft.

6. A mechanism according to claim 1, wherein said first coupling connects the one end of the first link means to the periphery of the wobble plate at a location intermediate two of said arms by which the pistons are connected to the wobble plate.

7. A mechanism according to claim 1, wherein said mechanism is a fixed displacement type, said second coupling connecting the one end of said second link means to a fixed said mounting on the cylinder block or engine case.

8. A mechanism according to claim 1, wherein said mechanism is of a variable displacement type and includes drawing means for moving the mainshaft axially to change the position and angle of the wobble plate, said second coupling connecting the one end of the second link means to a movable said mounting on the cylinder block or engine case, and said drawing means being operable to move said mounting in unison with axial movement of the mainshaft.

9. A mechanism according to claim 8, wherein said drawing system includes an annular cylinder fixed to the cylinder block or associated case, the cylinder being concentric with respect to the mainshaft and having a non-rotatable annular piston axially fixed relative to the mainshaft, the system being operable such that movement of the piston under pressure in the cylinder moves the mainshaft along its axis; the piston being connected to a mounting bar spaced from the mainshaft and movable parallel thereto with movement of the piston, said second coupling connecting the one end of the second link means to said mounting bar such that said first and second link means are adjustable in unison with movement of the mainshaft under the action of said drawing system.

10. A mechanism according to claim 9, wherein said piston is mounted exteriorly on a cylindrical hub located concentrically between said piston and mainshaft, said mainshaft being axially fixed within said hub but rotatable therein.

11. A mechanism according to claim 9, wherein the piston and cylinder of the drawing system are in a single acting configuration.

12. A mechanism according to claim 9, wherein the piston and cylinder of the drawing system are in a double acting configuration.

* * * * *